United States Patent [19]

Hayes

[11] 4,109,888

[45] Aug. 29, 1978

[54] FLUTE LYRE HOLDER

[76] Inventor: James D. Hayes, 2011 W. 6th St., Topeka, Kans. 66606

[21] Appl. No.: 783,710

[22] Filed: Apr. 1, 1977

[51] Int. Cl.[2] ..... E01B 7/02

[52] U.S. Cl. ..... 248/443; 248/229; 248/230

[58] Field of Search ..... 248/443, 444, 229, 230

[56] References Cited

U.S. PATENT DOCUMENTS

| | | | |
|---|---|---|---|
| 392,588 | 11/1888 | Cone | 248/230 |
| 759,048 | 5/1904 | Walter | 248/444 |
| 1,539,042 | 5/1925 | Dennis | 248/443 |
| 1,772,478 | 8/1930 | Carne | 248/444 |
| 2,263,554 | 11/1941 | Brach | 248/229 |
| 3,539,143 | 11/1970 | Johnston | 248/443 |

*Primary Examiner*—Roy D. Frazier

*Assistant Examiner*—Peter A. Aschenbrenner

*Attorney, Agent, or Firm*—Schmidt, Johnson, Hovey & Williams

[57] ABSTRACT

A simplified lyre holder for flutes is provided which allows full adjustment of both the lyre and support rod therefor, and has specialized securing structure for simultaneously gripping the flute and support rod with manipulation of only a single thumbscrew to greatly facilitate adjustment of the lyre to suit a particular flute player. The holder assembly includes a resilient, unitary, generally C-shaped flute-gripping element having a pair of laterally projecting, bored arms; one of the arms is grooved to adjustably receive the end of the support rod, and a single thumbscrew is positioned within the arm bores such that a simple tightening of the latter serves to lock the assembly in place in a single operation.

2 Claims, 6 Drawing Figures

FLUTE LYRE HOLDER

This invention relates to a lyre holder assembly especially adapted for use with conventional flutes. More particularly, it is concerned with a simplified lyre holder which is designed to facilitate precise adjustment of the lyre with the use of only a single thumbscrew.

Lyre holders for various musical instruments including flutes are well known. These in general include a lyre for holding a sheet of music or the like, in conjunction with an elongated rod and means for securing the rod to the instrument. However, many prior lyre holders are deficient in that they lack full adjustability, or require a relatively complicated procedure to effect adjustment of the position of the lyre. For example, some of these assemblies are provided with separate tightening screw elements for the instrument-gripping and rod-gripping sections thereof, and this oftentimes means that accurate adjustment of the lyre is difficult.

It is therefore the most important object of the present invention to provide a flute lyre holder assembly which overcomes many of the deficiencies of prior art units through provision of structure allowing securement of the lyre support rod to the flute in a single operation, so that positioning and adjustment of the lyre is greatly facilitated in order to suit the needs of particular flute players.

As a corollary to the foregoing, another object of the invention is to provide an assembly which includes a lyre, an elongated support rod therefor, and securing structure for mounting the rod to a flute which includes a unitary, resilient, generally C-shaped element for substantially circumscribing and gripping the flute body, a pair of adjacent, radially outwardly projecting arms extending from the element with at least one of the arms presenting a support rod-receiving opening therein, and releasable means for selectively drawing the arms together for simultaneously causing the C-shaped element to grip the flute and said arms to grip the lyre support rod.

Figure 1:
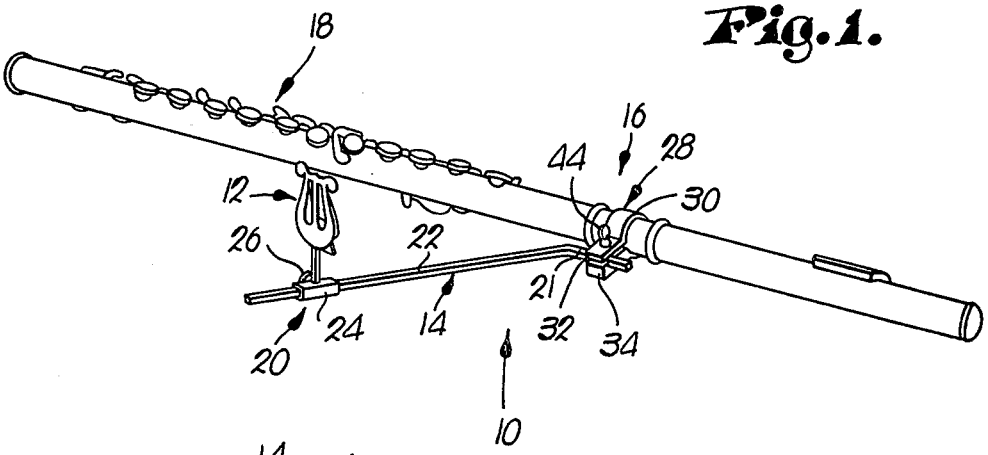
FIG. 1 is a perspective view of a conventional flute having the lyre holder assembly of the present invention mounted thereon.

Lyre holder assembly 10 broadly includes a conventional lyre 12 for holding a sheet of music or the like, an elongated lyre-supporting rod 14, and specialized securement structure 16 for securing rod 14 to a conventional flute 18 in order to maintain the lyre and sheet music carried thereby in a disposition facilitating reading of the music by a flute player. Coupling means 20 between the lyre 12 and rod 14 is also provided, and in preferred forms permits adjustment of the lyre along the length of the rod.

In more detail, support rod 14 is preferably of square cross section and includes a first, relatively short section 21 which is substantially parallel with the longitudinal axis of flute 18 when mounted (see FIG. 3), along with an obliquely oriented, longer second section 22. Lyre 12 also preferably includes coupling means in the form of a tubular fixture 24 which is mounted on and slidable along the length of second rod section 22. A releasable set screw 26 extends through fixture 24 and bears against rod section 22. This coupling means allows the position of lyre 12 to be altered simply by releasing set screw 26, shifting fixture 24 as desired, and retightening the set screw.

Securement structure 16 includes a unitary member 28 formed of a resilient, synthetic resin material. Member 28 has a generally C-shaped or generally annular element 30 which is sized for substantially circumscribing and gripping flute 18 intermediate the ends thereof. In addition, member 28 includes a pair of radially outwardly projecting arms 32 and 34 which extend from and in part define the proximal ends of element 30. Lowermost arm 34 as viewed in FIGS. 2, 4, 5 and 6 is configured to present a transversely extending rectangular, rod-receiving slot 36. It is to be particularly noted in this respect that the upright walls 38 which partly define slot 36 are of lesser height than the width of the sidewalls of rod 14.

The arms 32 and 34 are also provided with respective bores 40 and 42. Bore 42 provided through arm 34 is threaded, while bore 40 has smooth sidewalls. A thumbscrew 44 having a threaded shank 46 is located within the aligned bores 40 and 42, and is threaded into the latter.

Figure 3:
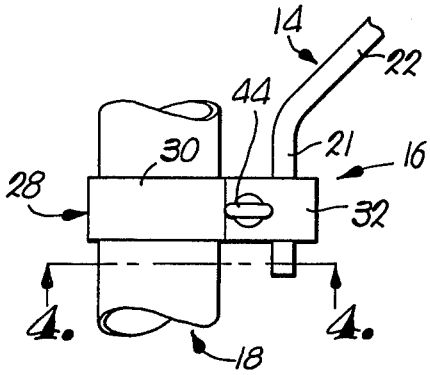
FIG. 3 is a fragmentary plan view of a flute, and the lyre support rod and securement structure of the present invention.
Figure 2:
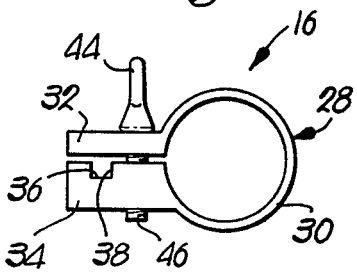
FIG. 2 is a front elevational view of the securement structure provided with the assembly.
Figure 6:
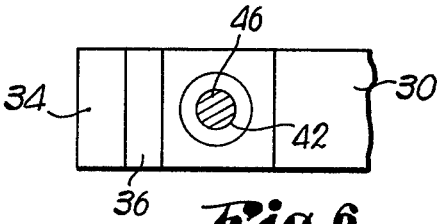
FIG. 6 is a sectional view taken along line 6—6 of FIG. 5.
Figure 4:
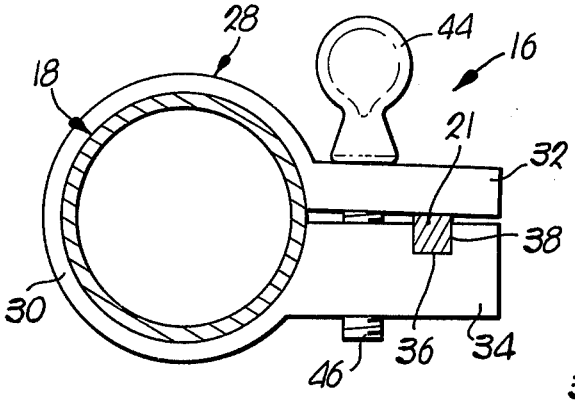
FIG. 4 is an enlarged vertical sectional view taken along line 4—4 of FIG. 3.
Figure 5:
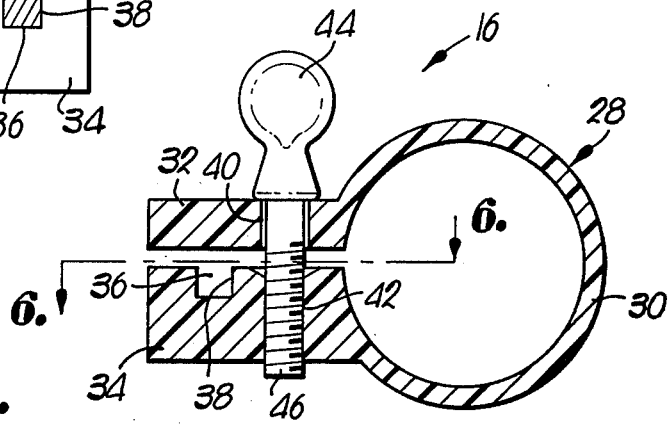
FIG. 5 is a vertical sectional view of the securement structure.

As best seen in FIGS. 3 and 4, first section 20 of rod 14 is positioned within slot 36 of arm 34, with a portion of the rod extending above the top wall of the arm. Tightening of the thumbscrew 44 thus causes the adjacent arms 32 and 34 to cooperatively grip rod 14 at a desired point along section 21 thereof. Moreover, this tightening of thumbscrew 44 simultaneously causes C-shaped element 30 to contract and effectively grip flute 18.

From the foregoing, it will be appreciated that only a single element, namely thumbscrew 44, serves to rigidify the securement structure 16; at the same time, adjustment of the position of element 30 and/or rod 14 can be effected simply by loosening thumbscrew 44, adjusting the securement structure as necessary, and retightening the thumbscrew.

Having thus described the invention, what is claimed as new and desired to be secured by Letters Patent is:

1. A flute lyre holder assembly, comprising:

a lyre for holding a sheet of music or the like;

an elongated support rod having at least a portion thereof presenting, in cross section, at least one planar outer surface;

coupling means connecting said lyre to said rod; and structure for connecting said rod to said flute for preventing undesired axial rotation and axial shifting of the rod in order to continuously maintain said lyre and sheet of music in a disposition facilitating reading of the latter by a flute player, said connecting structure including a unitary, resilient, ring-like element for substantially completely circumscribing and gripping said flute intermediate the ends thereof, a pair of outwardly projecting arms extending from the proximal ends of said element, there being means defining respective, axially aligned bores through said arms, one of said bores being threaded;

means defining a transversely extending opening in at least one of said arms which is complemental with at least a part of the cross sectional shape of said portion of said support rod for receiving the latter and, in cooperation with said other arm, preventing axial rotation of the rod relative to said element and arms when the latter are drawn together and in engagement with the rod; and releasable securing means for simultaneously drawing said arms together to clamp said element about said flute, and for causing said arms to grip said rod and prevent axial rotation and axial shifting of the latter, said securing means consisting of a thumbscrew located within and bridging said arms and threaded into said one bore, said thumbscrew being the sole securing means provided with said assembly.

2. The flute lyre holder assembly as set forth in claim 1, wherein said portion of said support rod is of substantially square cross section, and wherein said opening is complemental with said square cross section for receiving said portion of said support rod.

* * * * *